US008960272B2

(12) United States Patent
Wright et al.

(10) Patent No.: US 8,960,272 B2
(45) Date of Patent: Feb. 24, 2015

(54) RF APPLICATOR HAVING A BENDABLE TUBULAR DIELECTRIC COUPLER AND RELATED METHODS

(75) Inventors: Brian Wright, Indialantic, FL (US); Murray Hann, Malabar, FL (US); Raymond Hewit, Palm Bay, FL (US)

(73) Assignee: Harris Corporation, Melbourne, FL (US)

( * ) Notice: Subject to any disclaimer, the term of this patent is extended or adjusted under 35 U.S.C. 154(b) by 487 days.

(21) Appl. No.: 13/349,713

(22) Filed: Jan. 13, 2012

(65) Prior Publication Data

US 2013/0180729 A1 Jul. 18, 2013

(51) Int. Cl.
*E21B 43/00* (2006.01)
*E21B 47/13* (2012.01)

(52) U.S. Cl.
USPC ..... 166/65.1; 166/380; 166/248

(58) Field of Classification Search
USPC ..... 166/380, 65.1, 384, 248
See application file for complete search history.

(56) References Cited

U.S. PATENT DOCUMENTS

| | | | | |
|---|---|---|---|---|
| 4,108,476 | A | 8/1978 | Krupp | 285/47 |
| 4,513,815 | A | 4/1985 | Rundell et al. | |
| 4,660,636 | A | 4/1987 | Rundell et al. | |
| 5,065,819 | A * | 11/1991 | Kasevich | 166/248 |
| 5,447,339 | A | 9/1995 | Marchal et al. | 285/47 |
| 6,616,192 | B1 | 9/2003 | Zoboli | 285/54 |
| 6,685,231 | B2 | 2/2004 | Borner et al. | 285/47 |
| 7,032,930 | B2 | 4/2006 | Sutherland et al. | 285/47 |
| 7,207,603 | B2 | 4/2007 | Segreto | 285/47 |
| 7,441,597 | B2 | 10/2008 | Kasevich | 166/247 |
| 7,722,088 | B2 | 5/2010 | Pionetti | 285/123.3 |
| 7,784,547 | B2 | 8/2010 | Reddy | 166/360 |
| 7,798,220 | B2 | 9/2010 | Vinegar et al. | 166/272.3 |
| 7,798,533 | B2 | 9/2010 | Waldner | 285/123.16 |
| 7,832,772 | B2 | 11/2010 | Leseman et al. | 285/47 |
| 7,845,373 | B2 | 12/2010 | Hickman et al. | 138/114 |
| 7,854,236 | B2 | 12/2010 | Jibb et al. | 137/15.11 |
| 7,891,421 | B2 | 2/2011 | Kasevich | 166/247 |
| 7,950,453 | B2 | 5/2011 | Farmayan et al. | 166/272.1 |
| 2010/0078163 | A1 | 4/2010 | Banerjee et al. | 166/248 |
| 2010/0294489 | A1 | 11/2010 | Dreher, Jr. et al. | 166/248 |
| 2011/0230091 | A1 * | 9/2011 | Krenceski et al. | 439/578 |

* cited by examiner

*Primary Examiner* — Cathleen Hutchins
(74) *Attorney, Agent, or Firm* — Allen, Dyer, Doppelt, Milbrath & Gilchrist, P.A.

(57) ABSTRACT

A radio frequency (RF) applicator may be rotated during positioning within a wellbore in a subterranean formation. The wellbore may have at least one bend therein. The RF applicator may include a series of tubular conductors, and a respective bendable tubular dielectric coupler rotationally interlocking opposing ends of adjacent ones of the series of tubular conductors to define a tubular antenna. The RF applicator may include at least one RF feed conductor extending within the tubular antenna and connected to the series of tubular conductors.

17 Claims, 9 Drawing Sheets

RF APPLICATOR HAVING A BENDABLE TUBULAR DIELECTRIC COUPLER AND RELATED METHODS

FIELD OF THE INVENTION

The present invention relates to the field of radio frequency (RF) equipment, and, more particularly, to an RF applicator, such as, for hydrocarbon resource recovery using RF heating.

BACKGROUND OF THE INVENTION

Energy consumption worldwide is generally increasing, and conventional hydrocarbon resources are being consumed. In an attempt to meet demand, the exploitation of unconventional resources may be desired. For example, highly viscous hydrocarbon resources, such as heavy oils, may be trapped in sands where their viscous nature does not permit conventional oil well production. This category of hydrocarbon resource is generally referred to as oil sands. Estimates are that trillions of barrels of oil reserves may be found in such oil sand formations.

In some instances these oil sand deposits are currently extracted via open-pit mining. Another approach for in situ extraction for deeper deposits is known as Steam-Assisted Gravity Drainage (SAGD). The heavy oil is immobile at reservoir temperatures and therefore the oil is typically heated to reduce its viscosity and mobilize the oil flow. In SAGD, pairs of injector and producer wells are formed to be laterally extending in the ground. Each pair of injector/producer wells includes a lower producer well and an upper injector well. The injector/production wells are typically located in the payzone of the subterranean formation between an underburden layer and an overburden layer.

The upper injector well is used to typically inject steam, and the lower producer well collects the heated crude oil or bitumen that flows out of the formation, along with any water from the condensation of injected steam. The injected steam forms a steam chamber that expands vertically and horizontally in the formation. The heat from the steam reduces the viscosity of the heavy crude oil or bitumen which allows it to flow down into the lower producer well where it is collected and recovered. The steam and gases rise due to their lower density so that steam is not produced at the lower producer well and steam trap control is used to the same affect. Gases, such as methane, carbon dioxide, and hydrogen sulfide, for example, may tend to rise in the steam chamber and fill the void space left by the oil defining an insulating layer above the steam. Oil and water flow is by gravity driven drainage, into the lower producer well.

Operating the injection and production wells at approximately reservoir pressure may address the instability problems that adversely affect high-pressure steam processes. SAGD may produce a smooth, even production that can be as high as 70% to 80% of the original oil in place (OOIP) in suitable reservoirs. The SAGD process may be relatively sensitive to shale streaks and other vertical barriers since, as the rock is heated, differential thermal expansion causes fractures in it, allowing steam and fluids to flow through. SAGD may be twice as efficient as the older cyclic steam stimulation (CSS) process.

Many countries in the world have large deposits of oil sands, including the United States, Russia, and various countries in the Middle East. Oil sands may represent as much as two-thirds of the world's total petroleum resource, with at least 1.7 trillion barrels in the Canadian Athabasca Oil Sands, for example. At the present time, only Canada has a largescale commercial oil sands industry, though a small amount of oil from oil sands is also produced in Venezuela. Because of increasing oil sands production, Canada has become the largest single supplier of oil and products to the United States. Oil sands now are the source of almost half of Canada's oil production, although due to the 2008 economic downturn work on new projects has been deferred, while Venezuelan production has been declining in recent years. Oil is not yet produced from oil sands on a significant level in other countries.

U.S. Published Patent Application No. 2010/0078163 to Banerjee et al. discloses a hydrocarbon recovery process whereby three wells are provided: an uppermost well used to inject water, a middle well used to introduce microwaves into the reservoir, and a lowermost well for production. A microwave generator generates microwaves which are directed into a zone above the middle well through a series of waveguides. The frequency of the microwaves is at a frequency substantially equivalent to the resonant frequency of the water so that the water is heated.

Along these lines, U.S. Published Application No. 2010/0294489 to Dreher, Jr. et al. discloses using microwaves to provide heating. An activator is injected below the surface and is heated by the microwaves, and the activator then heats the heavy oil in the production well. U.S. Published Application No. 2010/0294489 to Wheeler et al. discloses a similar approach.

U.S. Pat. No. 7,441,597 to Kasevich discloses using a radio frequency generator to apply RF energy to a horizontal portion of an RF well positioned above a horizontal portion of a oil/gas producing well. The viscosity of the oil is reduced as a result of the RF energy, which causes the oil to drain due to gravity. The oil is recovered through the oil/gas producing well.

U.S. Pat. No. 7,891,421, also to Kasevich, discloses a choke assembly coupled to an outer conductor of a coaxial cable in a horizontal portion of a well. The inner conductor of the coaxial cable is coupled to a contact ring. An insulator is between the choke assembly and the contact ring. The coaxial cable is coupled to an RF source to apply RF energy to the horizontal portion of the well.

Unfortunately, long production times, for example, due to a failed start-up, to extract oil using SAGD may lead to significant heat loss to the adjacent soil, excessive consumption of steam, and a high cost for recovery. Significant water resources are also typically used to recover oil using SAGD which impacts the environment. Limited water resources may also limit oil recovery. SAGO is also not an available process in permafrost regions, for example or areas that may lack sufficient cap rock, are considered "thin" payzones, or payzones that have interstitial layers of shale. While RF heating may address some of these shortcomings, further improvements to RF heating may be desirable. For example, it may be relatively heating may be desirable. For example, it may be relatively difficult to install or integrate RF heating equipment into existing wells.

SUMMARY OF THE INVENTION

In view of the foregoing background, it is therefore an object of the present invention to provide a robust, readily positioned, and readily manufactured RF applicator for use in RF heating, such as for hydrocarbon resource recovery in a subterranean formation.

This and other objects, features, and advantages in accordance with the present invention are provided by a radio frequency (RF) applicator capable of being rotated during positioning within a wellbore in a subterranean formation, the wellbore having at least one bend therein. The RF applicator includes a series of tubular conductors, and a respective bendable tubular dielectric coupler rotationally interlocking opposing ends of adjacent ones of the series of tubular conductors to define a tubular antenna. The RF applicator also includes an RF feed conductor extending within the tubular antenna and connected to the series of tubular conductors. Accordingly, the RF applicator is robust, readily positioned, and readily manufactured, and thus may reduce RF heating implementation costs, for example.

The bendable dielectric coupler may include a series of tubular dielectric bodies. The bendable dielectric coupler may also include a respective compressible gasket between opposing ends of adjacent ones of the series of tubular dielectric bodies, for example.

Opposing ends of adjacent ones of the series of dielectric tubular bodies may have interlocking surface features. The interlocking surface features may define a sinusoidal shape, for example.

The bendable dielectric coupler may further include a protective sleeve surrounding the series of tubular dielectric bodies and compressible gaskets. The bendable tubular dielectric coupler may further include a pair of tubular transitions connected to respective end ones of the series of dielectric tubular bodies, and an elongate tension member extending between the pair of tubular transitions.

The series of tubular dielectric bodies and compressible gaskets may have an aligned passageway therein receive the elongate tension member. The RF applicator may further include an RF source coupled to the at least one RF feed conductor.

A method aspect is directed to a method for making a bendable tubular dielectric coupler for rotationally interlocking adjacent tubular conductors defining a radio frequency (RF) antenna capable of being rotated during positioning within a wellbore in a subterranean formation. The wellbore has at least one bend therein. The method includes forming a series of tubular dielectric bodies, and positioning a respective compressible gasket between opposing ends of adjacent ones of the series of tubular dielectric bodies.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime notation is used to indicate similar elements in alternative embodiments.

Figure 1:
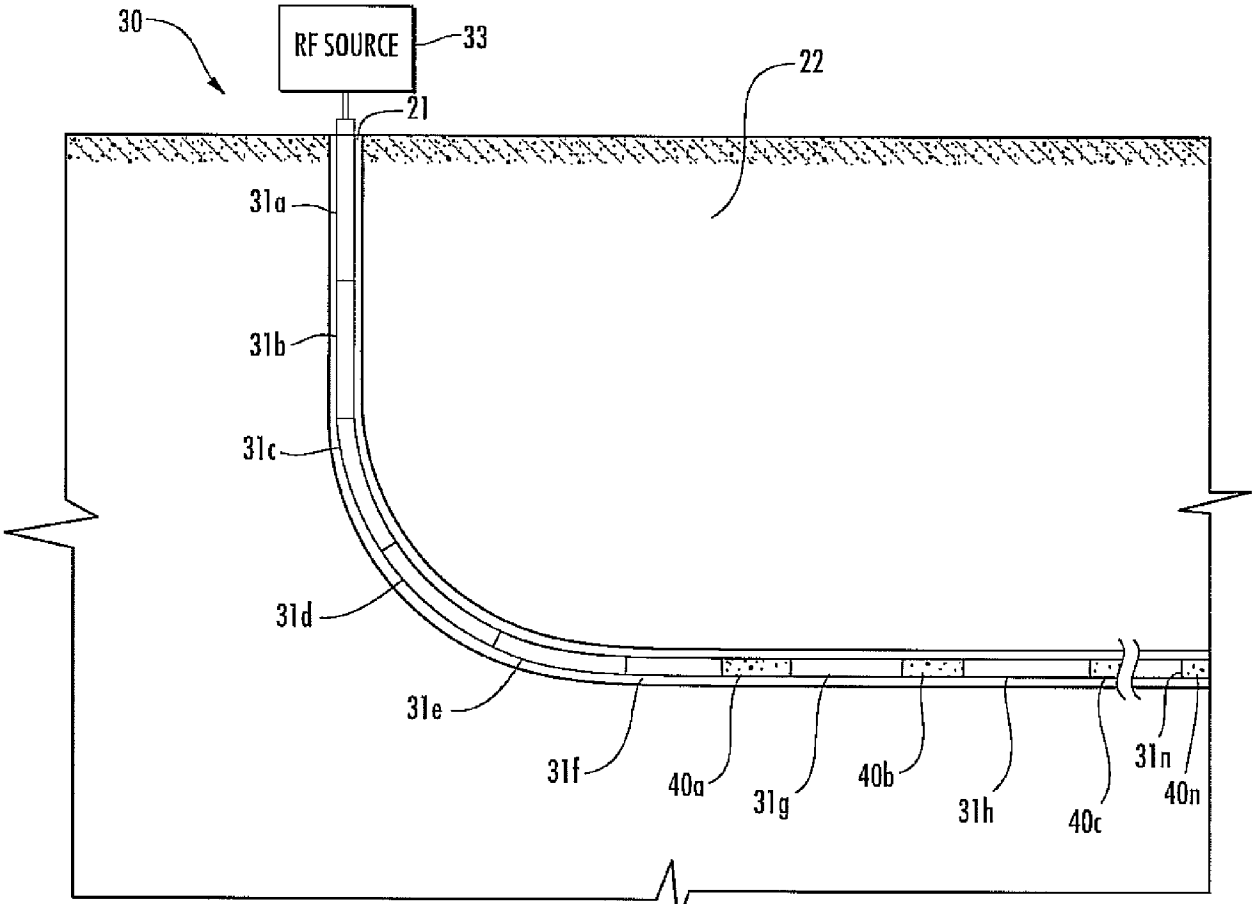
FIG. 1 is a schematic cross-sectional view of a subterranean formation including an RF applicator in accordance with the present invention.

Referring initially to FIG. 1, a radio frequency (RF) applicator 30 that is designed or adapted to be and capable of being rotated during positioning within a wellbore 21 in a subterranean formation 22 is described. In other words, the RF applicator 30 is capable surviving deployment bends and loads during positioning within a wellbore 21 in a subterranean formation 22. The subterranean formation 22 may include an oil sand formation, heavy oil formation, shale formation, natural gas formation, or other formation that would benefit from heating, for example.

The wellbore 21 has a bend therein so that the wellbore laterally extends within the subterranean formation. More than one wellbore 21 may be included to define a wellbore pair, for example, and may be positioned so that one wellbore is positioned vertically adjacent the another wellbore. This configuration may be particularly advantageous in SAGD where the upper wellbore is an injector wellbore, and the lower one is a producer wellbore. The RF applicator 30 may be used in or as the injector wellbore. Alternatively, or additionally, the RF applicator 30 may also be used in or as another wellbore, such as, for example, the producer wellbore, or a repair or an intermediate wellbore. Of course, the RF applicator 30 may be used in a location specifically drilled to facilitate production from a relatively difficult or non-homogeneous formation, for example.

The RF applicator 30 includes a series of tubular conductors 31*a*-31*n*. Each of the series of tubular conductors 31*a*-31*n* may be a drill pipe, as will be appreciated by those skilled in the art. For example, each of the series of tubular conductors 31*a*-31*n* may be 40 feet in length and have threads at opposing ends thereof. The threads may be Tenaris Blue™ thermal threads, available from Tenaris S.A., of Luxembourg, or may be other types of threads. Of course, the series of tubular conductors 31*a*-31*n* may be other lengths. The tubular conductors 31*a*-31*n* may be coupled together by respective conductive couplers.

Figure 2:
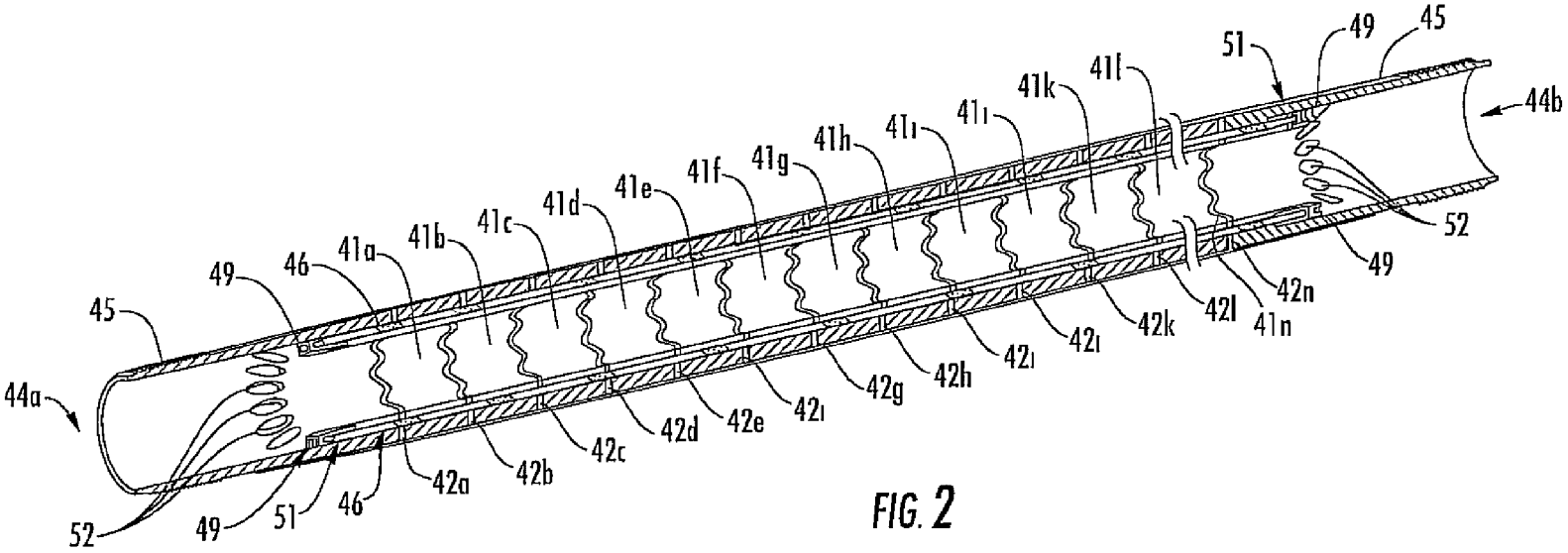
FIG. 2 is an cross-sectional view of the bendable tubular dielectric coupler of FIG. 1.
Figure 3:
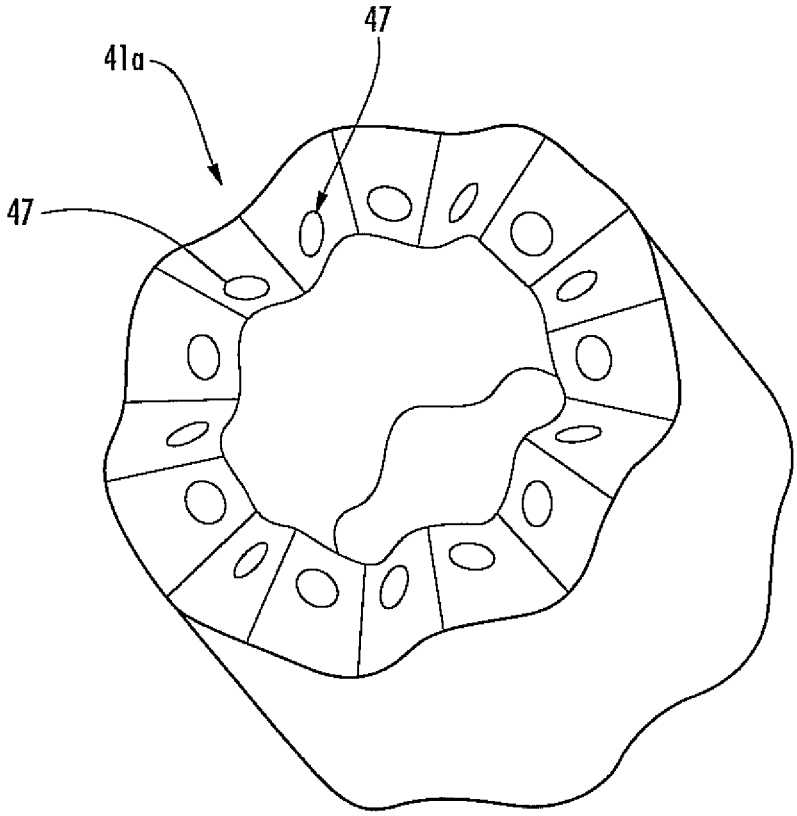
FIG. 3 is a perspective view of a tubular dielectric body of the bendable tubular dielectric coupler of FIG. 2.
Figure 4:
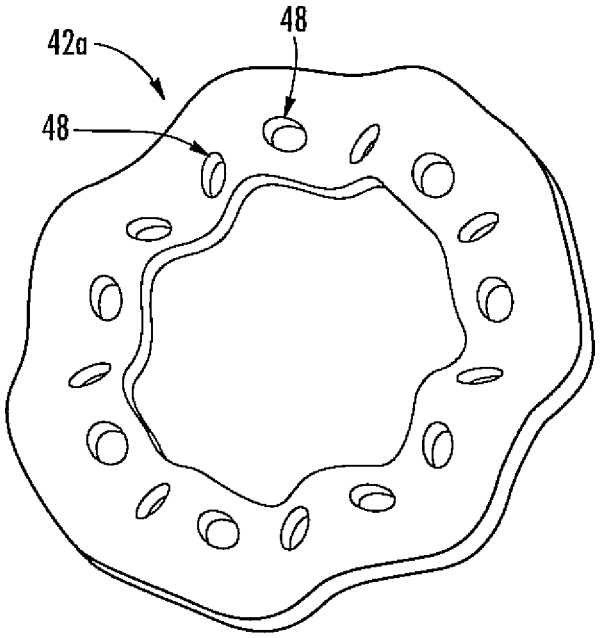
FIG. 4 is a perspective view of a compressible gasket of the bendable tubular dielectric coupler of FIG. 2.

Referring now additionally to FIGS. 2-4, the RF applicator 30 also includes respective bendable tubular dielectric couplers 40*a*-40*n* rotationally interlocking opposing ends of adjacent ones of the series of tubular conductors 31*f*, 31*g*, 31*h*, 31*n* to define a tubular antenna. The RF applicator 30 may be fed by twin-ax or co-ax for example. In the twin-ax implementation, for example, the RF applicator 30 includes a pair of spaced apart RF feed conductors 32*a*, 32*b* extending within the tubular antenna and connected to the series of tubular conductors 31*a*-31*n*. The RF applicator 30 may include other types of feed arrangements to define other types of antennas. An RF source 33, at ground level, is coupled to the RF feed conductors 32*a*, 32*b*. The RF source 33 cooperates with the RF feed conductors 32*a*, 32*b* and the tubular antenna to provide RF energy to adjacent portions of the subterranean formation 22. As will be appreciated by those skilled in the art, the RF energy may heat the adjacent subterranean formation 22 to increase the flow of hydrocarbon resources in the wellbore 21, for example, to increase recovery in a producer wellbore.

The bendable dielectric coupler 40*a* includes a series of tubular dielectric bodies 41*a*-41*n*. The series of tubular dielectric bodies 41*a*-41*n* may be ceramic, for example, and, more particularly, alumina ceramic. Of course, the series of tubular dielectric bodies 41*a*-41*n* may be another material. In a specific embodiment, the tubular dielectric bodies 41*a*-41*n* may be sized to be compatible with a common pipe size, but for a roughly 7 inch diameter pipe or liner, the series of tubular dielectric bodies may have an inner diameter of 4.375 inches and an outer diameter of 7.375 inches. The inner and outer diameters may be varied based upon the diameter of the series of tubular conductors 31*a*-31*n*, for example.

The bendable dielectric coupler 40*a* also includes a respective compressible gasket 42*a*-42*n* between opposing ends of adjacent ones of the series of tubular dielectric bodies 41*a*-42*n*. The compressible gaskets 42*a*-42*n* are compliant or bendable. The compressible gaskets 42*a*-42*n* may be plastic or elastomeric, for example, and more particularly, may be Torlon® 5030 available from Solvay Specialty Polymers of Brussels, Belgium. Torlon® 5030 is 30% glass reinforced, injection molded polyamide-imide (PAI) resin, and is particularly advantageous for higher load structural applications, for example, as during rotation when being positioning within the wellbore 21. The compressible gaskets 42*a*-42*n* may each be about ⅜ inches thick. Of course each of the compressible gaskets 42*a*-42*n* may be another thickness, and may also be less than a thickness of each of the tubular dielectric bodies 41*a*-41*n*.

Additionally, similar to the tubular dielectric bodies 41*a*-41*n*, the compressible gaskets 42*a*-42*n* may have an inner diameter of 4.375 inches and an outer diameter of 7.375 inches. The inner and outer diameters may be varied based upon the diameter of the compressible gaskets 42*a*-42*n*.

The opposing ends of adjacent ones of the series of tubular dielectric bodies 41*a*-41*n* have interlocking surface features. More particularly, the interlocking surface features define a sinusoidal shape in the illustrated embodiment. As will be appreciated by those skilled in the art, a sinusoidal shape may be easier to manufacture compared to other shapes, for example, interlocking teeth. Additionally, the sinusoidal shape also reduces the stresses in the each of the series of tubular dielectric bodies 41*a*-41*n*. This may be particularly advantageous when the RF applicator 30 is being positioned in the wellbore 21 by rotation. The sinusoidal shape allows the RF applicator 30 to be able to withstand increased torsional forces that develop from deployment into the wellbore, in similar fashion to a common drill string. The installation of one tubular antenna section onto another utilizes considerable "torque" (torsion) between adjacent sections, and each dielectric body 41 should be able to withstand this increased load. The interlocking surface features may also define a rectangular "keyway" like shape, or other shapes designed to torsionally lock the dielectric tubular bodies 41*a*-41*n* to each other.

Figure 5:
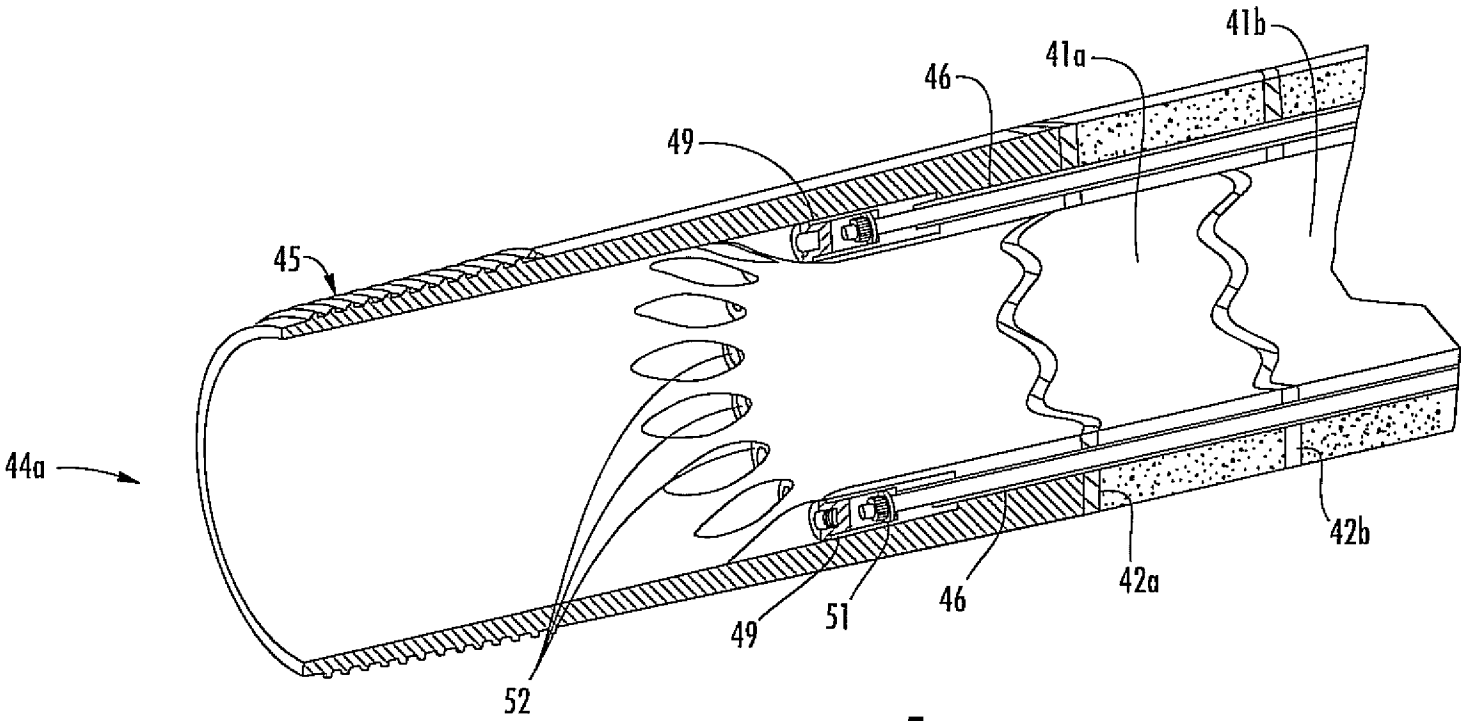
FIG. 5 is an enlarged cross-sectional view of an end of the bendable tubular dielectric coupler of FIG. 2.

Referring now additionally to FIG. 5, the bendable tubular dielectric coupler 40*a* further includes a pair of tubular transitions 44*a*, 44*b* connected to respective end ones 41*a*, 41*n* of the series of dielectric tubular bodies 41*a*-41*n*, and respective gaskets 42*a*, 42*n*. Each tubular transition 44*a*, 44*b* may be a monolithic unit, for example, machined or cast as a monolithic unit. Each tubular transition 44*a*, 44*b* illustratively includes a threaded outer end portion 45. The threaded outer end portion 45 is for connecting with a female-to-female threaded coupler, such as the coupler between adjacent ones of the series of tubular conductors 31*a*-31*n*. The pair of tubular transitions 44*a*, 44*b* may be beryllium-copper, for example, and may have a 7-inch outer diameter. The pair of tubular transitions 44*a*, 44*b* may be another material, for example, a relatively high-strength material, such as, for example, aluminum, steel, stainless steel, iron, copper, beryllium-cooper, or other alloys. The pair of tubular transitions 44*a*, 44*b* may be other materials and other sizes.

The pair of tubular transitions 44*a*, 44*b* may have the same interface, via the threaded outer end portion 45, as a drill pipe or the series of tubular conductors 31*a*-31*n*. This advantageously allows the use of the series of tubular conductors 31*a*-31*n* and bendable tubular couplers 40*a*-40*n* to define the antenna. Moreover, this reduces the impact to drilling operations.

The bendable tubular dielectric coupler 40 further includes respective elongate tension members 46 extending between the pair of tubular transitions 44*a*, 44*b*. More particularly, the series of tubular dielectric bodies 41*a*-41*n* and compressible gaskets 42*a*-42*n* have aligned passageways 47 therein to receive respective elongate tension members 46. The aligned passageways 47 are illustratively along a perimeter of the tubular dielectric bodies 41*a*-41*n* and compressible gaskets 42*a*-42*n*.

The elongate tension members 46 are illustratively in the form of threaded rods having a 5/16 inch diameter. The elongate tension members 46 may be Polyetrafluoroethylene (PTFE) insulated MP35N material. In other words the elongate tension members 46 may have a coating. As will be appreciated by those skilled in the art, MP35N is a nickel-cobalt base alloy and is available from Latrobe Specialty Steel Company of Latrobe, Pa. PTFE insulated MP35N provides a combination of increased strength and corrosion resistance, which may make it particularly useful in colder environments, for example. The elongate tension members 46 may be coated with another electrically insulating material, such as polyimide (commonly sold under the trademark Kapton® by Dupont Corporation), or polyamide-imides (commonly sold under the trademark Torlon®) or polyetherimide (commonly sold under the trademark Ultem®), or other material. The tension members may also be made from another high strength material, or such as, for example, high strength steel or nickel steel alloys. Sixteen elongate tensioning members 46 may be used with the tubular dielectric bodies 41*a*-41*n* and compressible gaskets 42*a*-42*n* having the above-noted dimensions. The number of elongate tensioning members 46 may be varied based upon the dimensions of the tubular dielectric bodies 41*a*-41*n* and compressible gaskets 42*a*-42*n* or as desired. Of course, other types of elongate tensioning members may be used, and in other embodiments may not extend within aligned passageways.

The tubular transitions 44*a*, 44*b* also include respective anchor points 49 in the form of insulated cups where a hardware fastener 51, for example, is affixed to each of the elongate tensioning members 46. The anchor points 49 advantageously insulate the elongate tensioning members 46 from the threaded outer end portion 45. More particularly, each elongate tensioning member 46 comes into the respective anchor point 49 or insulated cup via a spherical washer pair and then the hardware fastener 51, for example, a nut. The anchor points 49 are closed off with an end cap 52 or cover that may be ceramic-alumina, and is positioned to cover or seal access to the anchor points. The end cap 52 forms a seal which helps ensure that the elongate tensioning members 46 remain insulated from the threaded outer end portion 45. The elongate tension members 46 may be made also from a high tensile strength, non-conductive material, such as, for example, Spectra or Kevlar.

Figure 6:
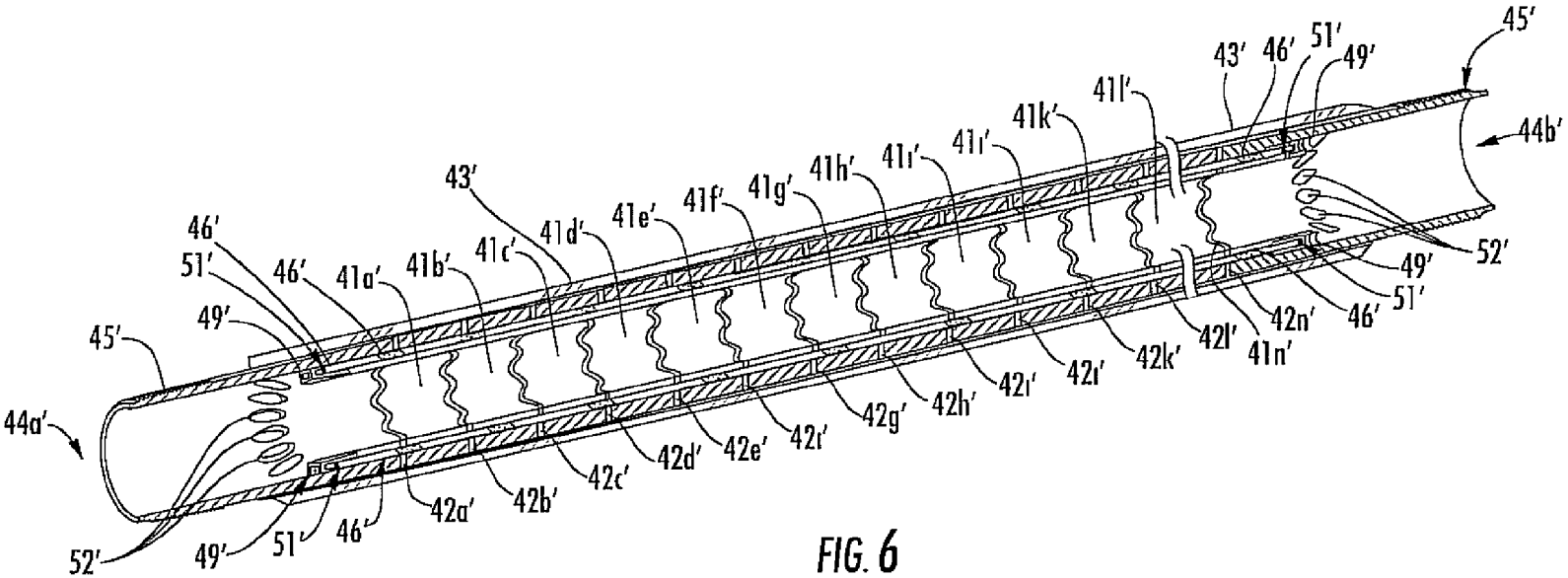
FIG. 6 a cross-section view of another embodiment of the bendable tubular dielectric coupler of FIG. 1.

Referring now to FIG. 6, in another embodiment the bendable dielectric coupler 40' further includes a protective sleeve 43' surrounding the series of tubular dielectric bodies 41*a*'-41*n*' and compressible gaskets 42*a*'-42*n*'. The protective sleeve 43' may be a dielectric material or coating, such as, PTFE. The protective sleeve 43' advantageously protects the series of tubular dielectric bodies 41*a*'-41*n*', i.e. ceramic, during installation or positioning within the wellbore 21'. Of course, the protective sleeve 43' may be other materials. The protective sleeve 43' may also include circular, washer like flanges that increase electrical path length between the threaded outer end portions 45'. The purpose of these flanges is to increase electrical path length, and thus reduce electrical shorting or arching between adjacent sections when exposed to conductive material in the subterranean formation, such as water.

The RF applicator 30 may be particularly advantageous since it may be sized for desired antenna operation. In other words, the length of each bendable tubular dielectric coupler may be adjusted to a desired length by adjusting the number of tubular dielectric bodies 41*a*-41*n* and respective compressible gaskets 42*a*-42*n*. Additional length may serve to increase electrical path length between the threaded outer end portions 45 and reduce electrical shorting or arching between adjacent sections when exposed to conductive material in the subterranean formation, such as water. In this way, the tubular dielectric bodies 41*a*-41*n* may be tailored to different formations, some of which are more conductive, for example, primarily due to higher total dissolved solids in the connate water.

The RF applicator 30 advantageously allows creation of an underground antenna utilizing drill pipe methods. Electrical isolation is maintained for the underground antenna segments, i.e. the series of tubular conductors 31*a*-31*n*. Moreover, no new tools may be needed for installation, as the configuration interfaces are that of a standard drill pipe, thus allowing use of all the existing drill tooling and installation techniques. This may reduce costs and/or may not delay the schedule of drilling operations.

Additionally, the RF applicator 30, and, in particular, the bendable dielectric coupler 40 support the weight of the drill pipe string, i.e. series of tubular conductors 31*a*-31*n*. The bendable tubular dielectric coupler 40 advantageously can bear relatively complex combinations of loads (compression, bending, torsion, tension) from rotational positioning in a wellbore during the installation process. The ceramic tubular dielectric bodies 41*a*-41*n* and plastic, i.e. elastomeric, gaskets 42*a*-42*n* may also structurally support bending loads and the full torque for joining drill string segments. In particular, the RF applicator 30 advantageously may allow a 10-degree bend for each 100 foot segment. The RF applicator 30 may also have increased environmental ruggedness in that it may survive more extreme environmental conditions, such as, temperature and pressure.

Still further, the RF applicator 30, including the bendable tubular dielectric couplers 40*a*-40*n* provides a sealed tube section for hydrocarbon/water extraction or steam/fluid injection. As will be appreciated by those skilled in the art, the RF applicator 30 may be analytically compared to the standard "J55" drill pipe system, and may obtain about 40-50%, and more preferably, approximately 50%, of those specifications, which is generally adequate for oil sands applications, for example.

Figure 7:
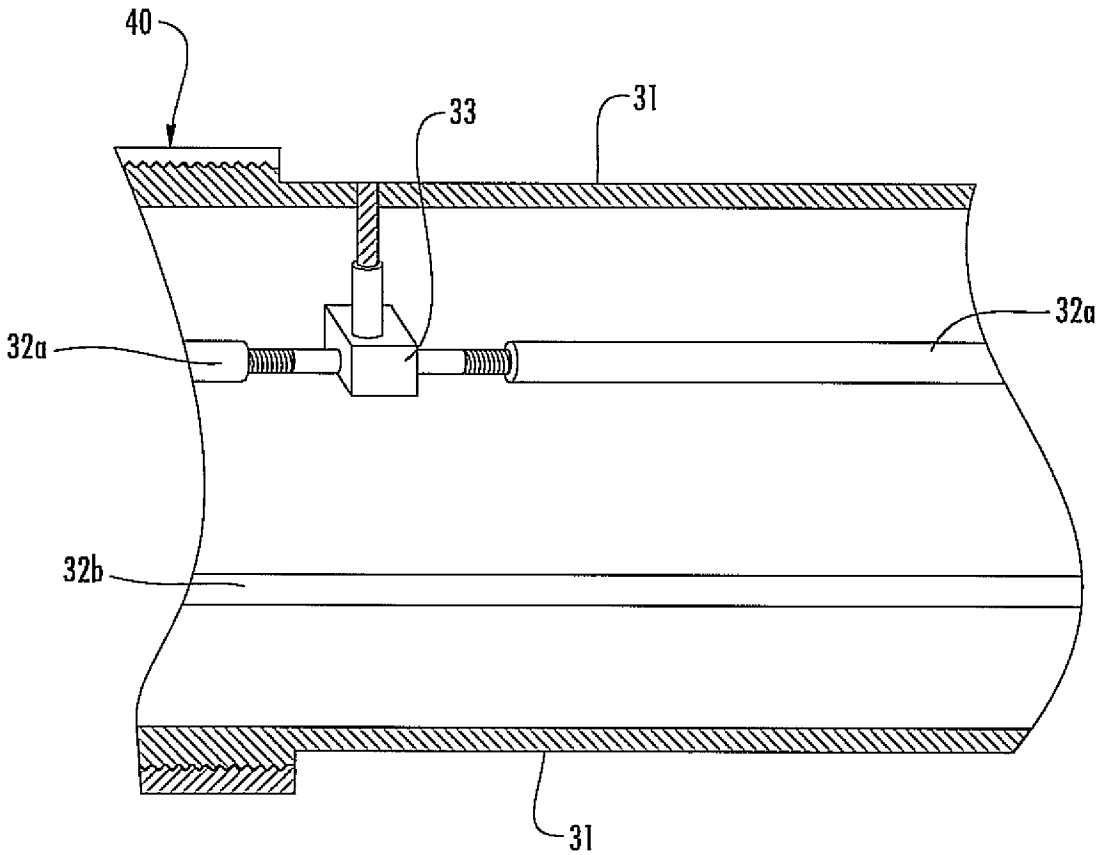
FIG. 7 is an enlarged cross-sectional view of a portion of an RF feed conductor coupling arrangement as used in the RF applicator of FIG. 1.

Referring now additionally to FIG. 7, an exemplary RF feed conductor coupling arrangement is illustrated. The first RF feed conductor 32*a*, in the form of an insulated stranded conductor, is coupled to the tubular conductor 31 via a T-shaped conductor bridge 37. The second RF feed conductor 32*b* is coupled to another tubular conductor on the opposite end of the bendable tubular dielectric coupler 40 via another conductor bridge. The conductor bridges 37 also aid in maintaining spacing of the RF feed conductors 32*a*, 32*b* from the tubular conductors 31 and from each other. As will be appreciated by those skilled in the art, electrical isolation is maintained between the tubular conductors 31.

Further details of antennas, for example, for which the bendable tubular dielectric coupler 40 may be particularly advantageous are disclosed in application Ser. No. 12/950,339 filed Nov. 19, 2010, and Ser. No. 12/950,287 filed Nov. 19, 2010, both of which are assigned to the present assignee, and both of which are herein incorporated in their entirety be reference.

Figure 8:
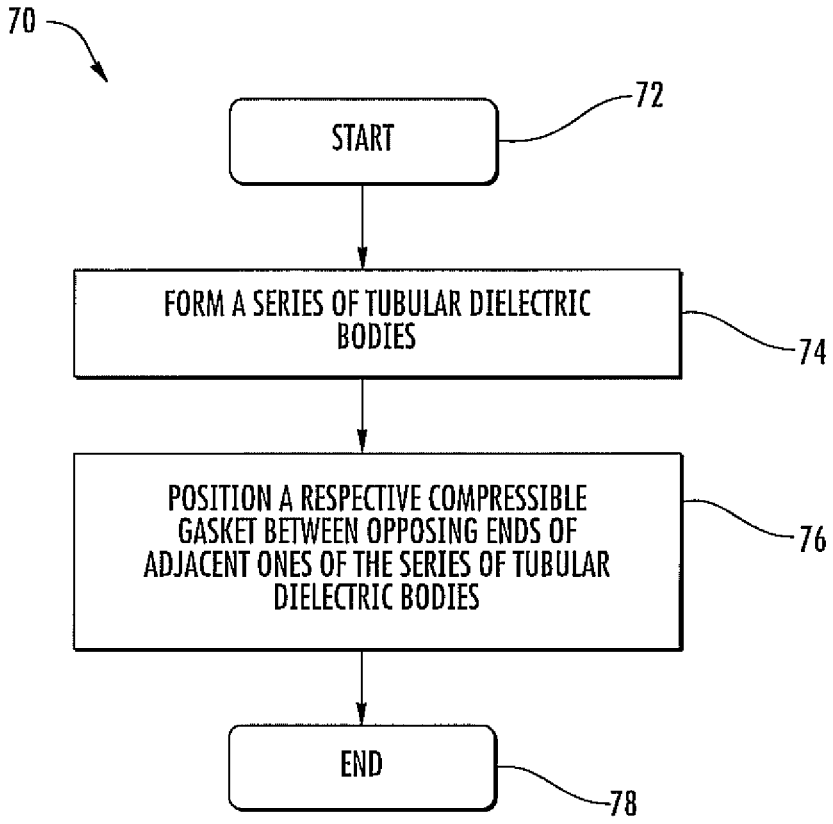
FIG. 8 is a flow chart of a method of making the bendable tubular dielectric coupler according to the present invention.

Referring now to the flowchart 70 in FIG. 8, beginning at Block 72 a method aspect is illustrated. At Block 74, the method includes forming a series of tubular dielectric bodies 41*a*-41*n*. The method further includes positioning a respective compressible gasket 42*a*-42*n* between opposing ends of adjacent ones of the series of tubular dielectric bodies 41*a*-41*n* (Block 76). The method ends at Block 78.

Figure 9:
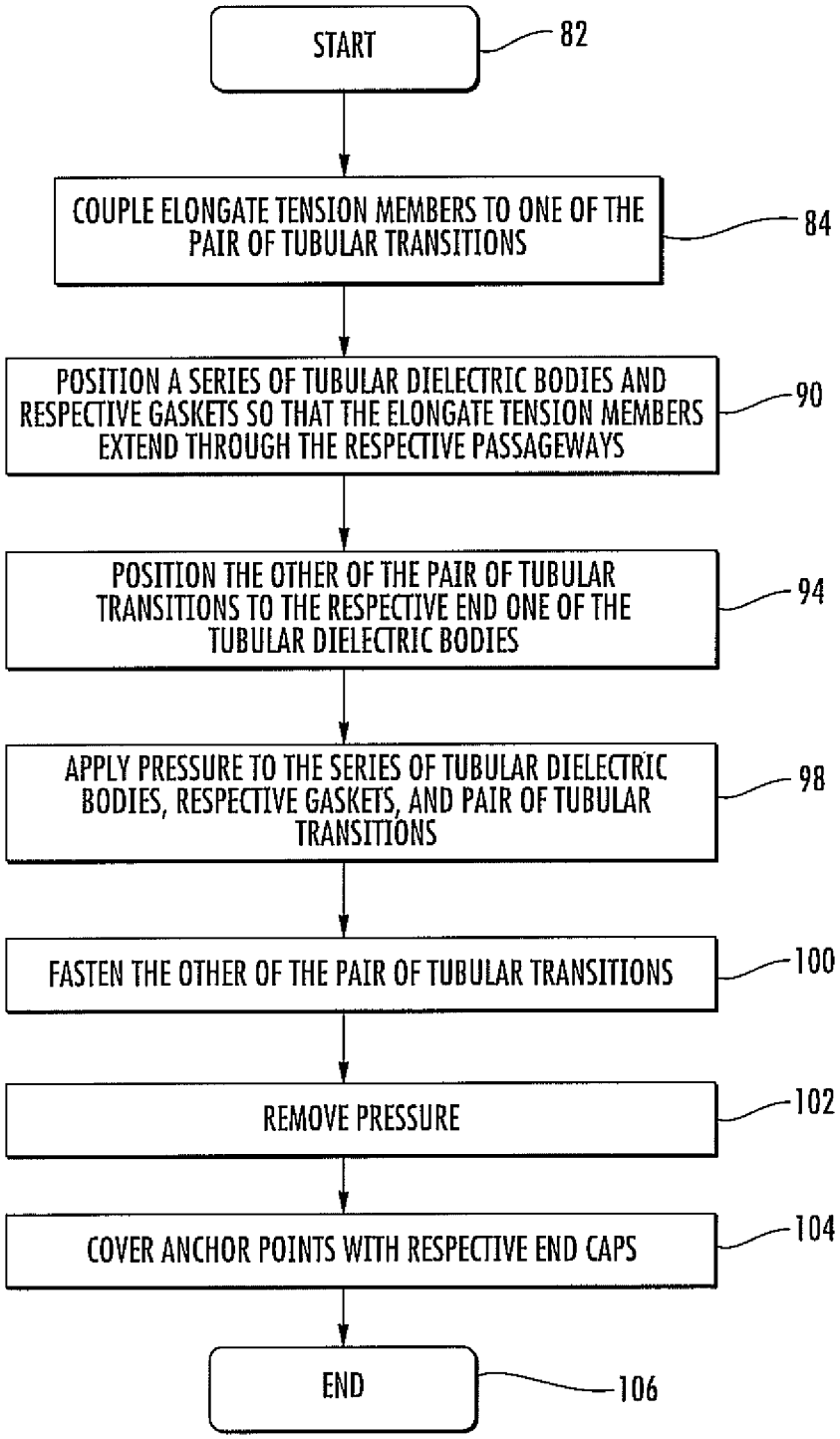
FIG. 9 is a flow chart of a more detailed method of making the bendable tubular dielectric coupler according to the present invention.

Referring now additionally to the flowchart 80 in FIG. 9, beginning at Block 82, another method for making the bendable tubular dielectric coupler 40 for rotationally interlocking adjacent tubular conductors 31*a*, 31*b* defining a radio frequency (RF) antenna designed to be and capable of being rotated during positioning within a wellbore in 21*a* subterranean formation 22 is illustrated. The wellbore has at least one bend therein. The method includes at Block 84, coupling the elongate tension members 46 to one of the pair of tubular transitions 44*a*.

At Block 90, the method includes positioning a series of tubular dielectric bodies 41*a*-41*n* and respective compressible gaskets 42*a*-42*n* so that the elongate tension members 46 extend through the respective passageways 47, 48. Of course, the tubular dielectric bodies 41*a*-41*n* and the respective compressible gaskets 42*a*-42*n* may be positioned alternatively so that the elongate tension members 46 extend through the respective passageways 47, 48. At Block 94, the other of the pair of tubular transitions 44*b* is positioned to the respective end one of the tubular dielectric bodies 41*a*-41*n*. The elongate tension members 46 extend to the anchor points 49 of the tubular transition.

At Block 98, pressure is longitudinally applied to the bendable tubular dielectric coupler 40, for example, hydraulically, to preload it in compression, or provide tension in the elongate tension members 46. At Block 100, while under pressure or loading, the fasteners 51 are tightened to achieve a uniform tensioning thereof. The pressure is removed at Block 102. At Block 104, respective end caps 52 are coupled to cover the anchor points 49. The method ends at Block 106.

Many modifications and other embodiments of the invention will also come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A radio frequency (RF) applicator capable of being rotated during positioning within a wellbore in a subterranean formation, the wellbore having at least one bend therein, the RF applicator comprising:

a series of tubular conductors;

a respective bendable tubular dielectric coupler comprising a series of tubular dielectric bodies rotationally interlocking opposing ends of adjacent ones of said series of tubular conductors to define a tubular antenna, opposing end faces of adjacent ones of said series of dielectric tubular bodies having interlocking surface features; and an RF feed conductor extending within said tubular antenna and connected to said series of tubular conductors.

2. The RF applicator of claim 1, wherein said bendable dielectric coupler comprises a respective compressible gasket between opposing ends of adjacent ones of said series of tubular dielectric bodies.

3. The RF applicator of claim 2, wherein said bendable dielectric coupler further comprises a protective sleeve surrounding said series of tubular dielectric bodies and compressible gaskets.

4. The RF applicator of claim 2, wherein said bendable tubular dielectric coupler further comprises:

a pair of tubular transitions connected to respective end ones of said series of dielectric tubular bodies; and at least one elongate tension member extending between said pair of tubular transitions.

5. The RF applicator of claim 4, wherein said series of tubular dielectric bodies and compressible gaskets have at least one aligned passageway therein to receive said at least one elongate tension member.

6. The RF applicator of claim 1, wherein the interlocking surface features define a sinusoidal shape.

7. The RF applicator of claim 1, further comprising an RF source coupled to said RF feed conductor.

8. A bendable tubular dielectric coupler for rotationally interlocking adjacent tubular conductors defining a radio frequency (RF) antenna to be rotated during positioning within a wellbore in a subterranean formation, the wellbore having at least one bend therein, the bendable tubular dielectric coupler comprising:

a series of tubular dielectric bodies, opposing end faces of adjacent ones of said series of dielectric tubular bodies having interlocking surface features; and a respective compressible gasket between opposing ends of adjacent ones of said series of tubular dielectric bodies.

9. The bendable tubular dielectric coupler of claim 8, wherein the interlocking surface features define a sinusoidal shape.

10. The bendable tubular dielectric coupler of claim 8, further comprising a protective sleeve surrounding said series of tubular dielectric bodies and compressible gaskets.

11. The bendable tubular dielectric coupler of claim 8, further comprising:

a pair of tubular transitions connected to respective end ones of said series of dielectric tubular bodies; and at least one elongate tension member extending between said pair of tubular transitions.

12. The bendable tubular dielectric coupler of claim 11, wherein said series of tubular dielectric bodies and compressible gaskets have at least one aligned passageway therein to receive said at least one elongate tension member.

13. A method for making a bendable tubular dielectric coupler for rotationally interlocking adjacent tubular conductors defining a radio frequency (RF) antenna capable of being rotated during positioning within a wellbore in a subterranean formation, the wellbore having at least one bend therein, the method comprising:

forming a series of tubular dielectric bodies so that opposing end faces of adjacent ones of the series of dielectric tubular bodies have interlocking surface features; and positioning a respective compressible gasket between opposing ends of adjacent ones of the series of tubular dielectric bodies.

14. The method of claim 13, wherein the interlocking surface features define a sinusoidal shape.

15. The method of claim 13, further comprising a positioning a protective sleeve to surround the series of tubular dielectric bodies and compressible gaskets.

16. The method of claim 13, further comprising:

connecting a pair of tubular transitions to respective end ones of the series of dielectric tubular bodies; and positioning at least one elongate tension member between the pair of tubular transitions.

17. The method of claim 16, wherein positioning the at least one elongate tension member comprises positioning the at least one elongate tension member within at least one aligned passageway therein the series of tubular dielectric bodies and the compressible gaskets.

* * * * *